United States Patent [19]

Opsvik

[11] 4,109,961

[45] Aug. 29, 1978

[54] ADJUSTABLE CHAIR

[75] Inventor: Peter Opsvik, Oslo, Norway

[73] Assignee: Stokke Fabrikker A/S, Spjelkavik, Norway

[21] Appl. No.: 567,999

[22] Filed: Apr. 14, 1975

Related U.S. Application Data

[63] Continuation of Ser. No. 411,654, Nov. 1, 1973, abandoned.

[30] Foreign Application Priority Data

Nov. 1, 1972 [NO] Norway ..... 3953/72

[51] Int. Cl.[2] ..... A47C 3/20; A47C 3/38

[52] U.S. Cl. ..... 297/338; 108/96; 108/110; 297/130; 297/423

[58] Field of Search ..... 297/130, 239, 338, 423, 297/429, 430, 440, 442; 108/96, 107–110; 182/33, 120, 132

[56] References Cited

U.S. PATENT DOCUMENTS

| | | | |
|---|---|---|---|
| D. 180,364 | 5/1957 | Handin | 297/327 X |
| 1,587,253 | 6/1926 | Tarbox | 297/338 X |
| 1,786,663 | 12/1930 | Leek | 297/385 X |
| 2,234,562 | 3/1941 | Klopfer et al. | 297/338 X |
| 2,466,350 | 4/1949 | Anderson | 297/338 X |
| 2,538,231 | 1/1951 | Booth | 297/338 |
| 2,643,045 | 6/1953 | Renfro | 108/96 X |
| 3,575,465 | 4/1971 | Dolby et al. | 297/440 X |

FOREIGN PATENT DOCUMENTS

| | | | |
|---|---|---|---|
| 178,696 | 11/1905 | Fed. Rep. of Germany | 297/338 |
| 30,421 | 8/1933 | Netherlands | 297/338 |
| 71,817 | 6/1945 | Norway | 297/338 |
| 535,252 | 4/1941 | United Kingdom | 297/239 |

*Primary Examiner*—Roy D. Frazier
*Assistant Examiner*—William E. Lyddane
*Attorney, Agent, or Firm*—Watson, Cole, Grindle & Watson

[57] ABSTRACT

An adjustable chair includes a pair of upwardly extending spaced uprights having a plurality of horizontal grooves provided along the substantial length thereof at inner surfaces of the uprights and facing each other, a foot rest plate and a seat bottom plate member having opposite ends respectively disposed in opposite ones of the grooves at desired vertical locations along the uprights. The foot rest and the seat bottom are interchangeable and are tightly held in place by fastening means extending between the uprights.

4 Claims, 5 Drawing Figures

ADJUSTABLE CHAIR

This is a continuation, of application Ser. No. 411,654 filed Nov. 1, 1973, now abandoned.

The present invention relates to a chair of the type having side uprights and supporting members connected at the lower ends thereof, with a back rest provided at the top of the side uprights, said side uprights being provided with means for mounting a seat bottom in place at a predetermined height.

In accordance with known chair arrangements, seat bottoms are capable of being mounted thereon at various heights for, as an example, children at different ages. Known tables are likewise adjustable in height, although they are not practical. Chairs are therefore hereby provided which can be adapted for standard table hights, for children of different ages.

An object of the invention is to provide such a chair which is very simple and strong in its construction, and wherein the possibilities of variation and adaptation are numerous. Thus, chairs according to the invention can be effectively used by very small children as well as by children of different ages up to adult age.

For a more complete description of the invention, reference is made to an embodiment disclosed in the drawings.

Figure 1:
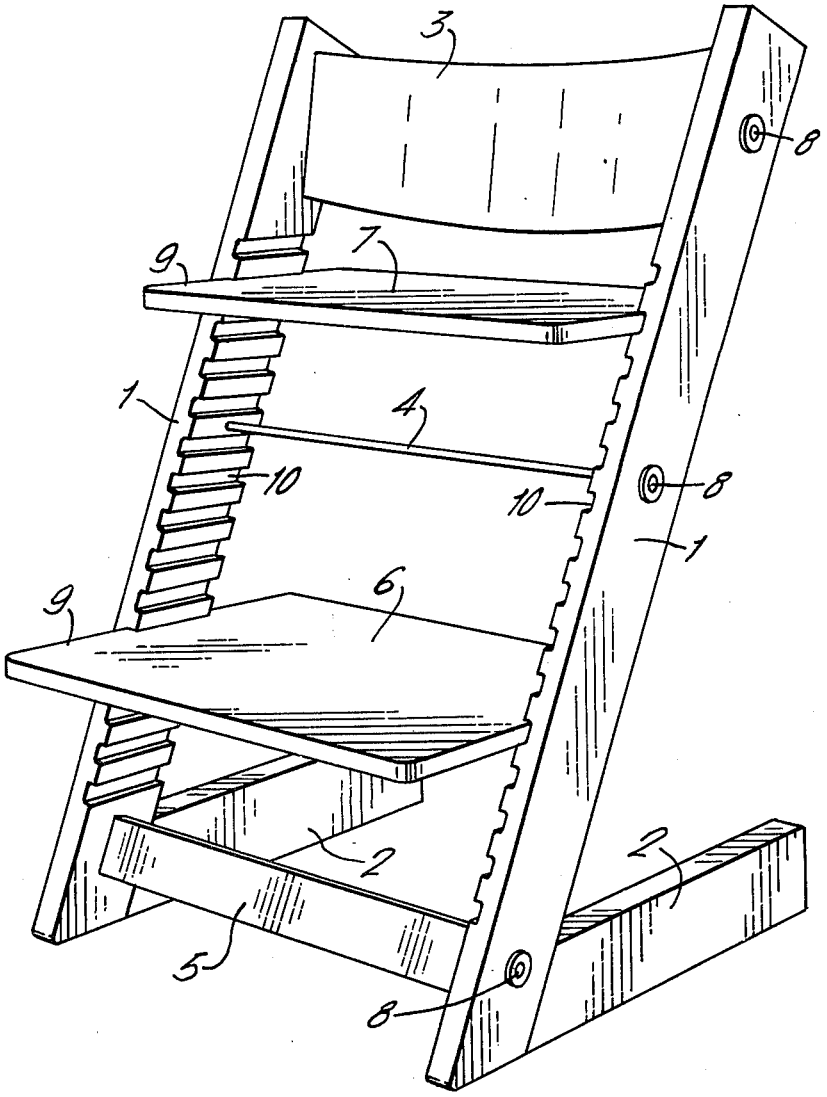
FIG. 1 shows a chair according to the invention seen in perspective.

The chair according to the embodiment shown, comprises two elongated side uprights 1 each of rectangular cross-section. These uprights can for instance be made of two strong wooden elements or they can be made of artificial material. The uprights are provided at their lower ends with supporting members 2 resting on the floor. The uprights are connected at their upper ends by a back rest plate 3, at their middle by a cross bar 4, and at their lower ends by a cross piece 5.

The inner surfaces of uprights 1 are provided with horizontal grooves 10 arranged at a substantial height along the uprights as clearly shown in FIG. 1. These grooves are adapted for the reception of a seat plate or seat bottom 7 at the opposite edges thereof, as well as a foot rest plate 6 at its opposite edges. The seat plate 7 is substantially shorter than the foot rest plate 6.

Figure 2:
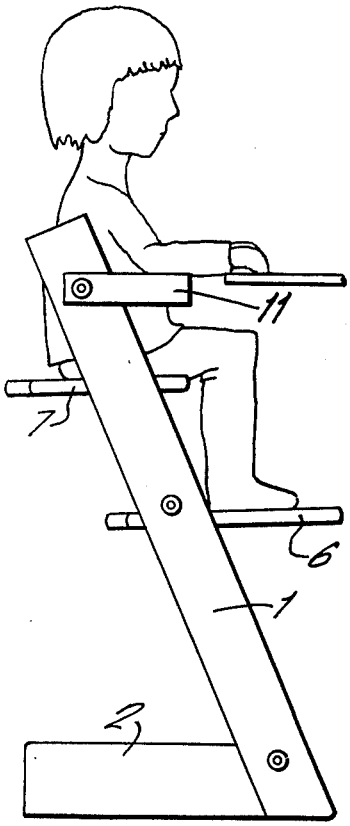
FIGS. 2–5 show the chair in different positions adapted for children of different ages.

By mounting the seat plate and foot rest in place at the desired height in relation to the table top, a chair is obtained which provides a satisfactory support for the user. Thus, a chair is shown in FIG. 2 adapted for a small child, the seat plate being placed in an upper pair of grooves 10 and the foot rest being correspondingly positioned, so that the child will be given a favorable support for his seat and feet. In the example shown, the chair is also provided with a strap 11 or the like, for preventing the child from falling forwardly. The chair thus can be used for very small children.

Figure 3:
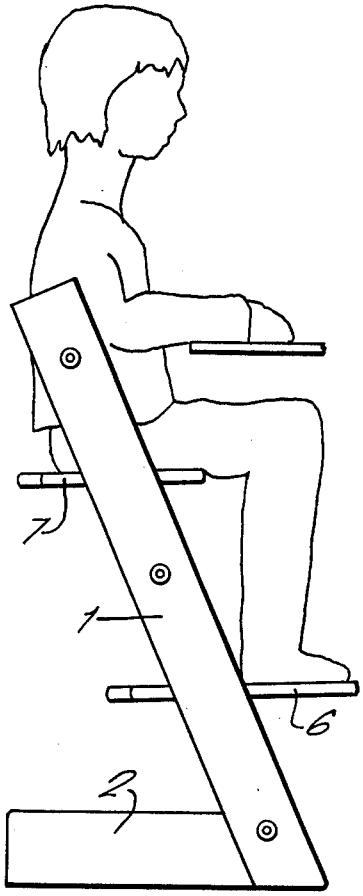

In FIG. 3 the chair is adapted for a somewhat bigger child. The seat and feet plate then are correspondingly mounted at convenient heights along the uprights to provide the correct sitting position.

Figure 4:
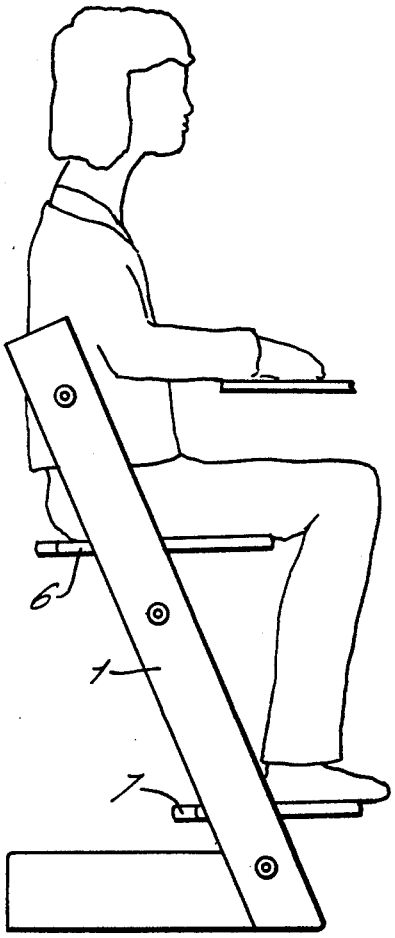

In FIG. 4 the chair is arranged for a bigger child. To give the correct seat depth and thus also good support for the seat of the child, foot plate 6 is used as seat plate and the seat plate 7 is used as foot rest.

Figure 5:
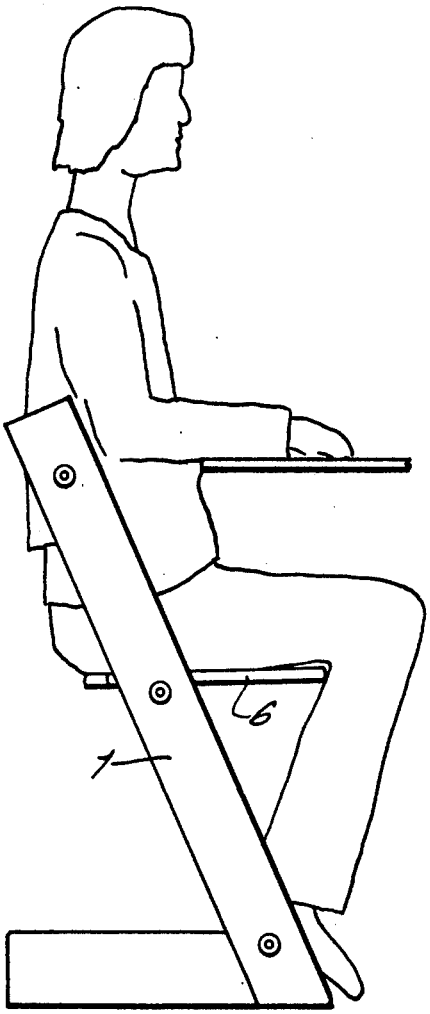

In FIG. 5 the chair finally is adapted for a large child or an adult. The seat plate still is provided by the somewhat longer foot rest plate 6, a foot plate as such is now omitted, the user sitting on the chair being able to use the floor as support for the feet.

It should be pointed out that the embodiment as shown is intended merely as an example illustrating the manner of carrying out the invention. The side uprights as well as their connecting members thus can be modified in many ways within the scope of the invention. In the example shown, the connection between the side uprights is provided by means of the members 3, 4 and 5. These are arranged together with screwnut arrangements, so that when nuts 8 at the outer surfaces of the uprights are tightened they will clamp and lock the seat and foot plates in the desired positions, in which they have been placed. Also, securing or locking means can, moreover, of course be used. The simplest manner of mounting the seat and foot plates in place is with their edges located in grooves 10 with such force fit that they are maintained in place by friction. Such a solution will, however, not be satisfying, because after a period of time some play will occur due to wear, so that elastic members would need to be inserted between cooperating parts or other locking means. By locking according to the embodiment shown, the advantage obtained is that the upper nuts 8 can serve as securing means for strap 11 when the chair is used for very small children.

I claim:

1. An individual chair adjustable to accommodate persons of any age and size, comprising: a pair of upwardly extending spaced uprights having ground supporting members at their lower ends; a chair back rest interconnecting said uprights at their upper ends; a seat bottom plate member; and a foot rest plate; said uprights having a plurality of horizontally extending guides provided along a portion of its length at the inner surfaces of said uprights facing each other, said seat bottom plate member and said foot rest plate each having opposite ends respectively disposed in opposite ones of said guides of said uprights at desirable locations between said ends of said uprights, said seat bottom plate member and said foot rest plate being interchangeable in dependence upon the size of the chair occupant so that when said seat bottom plate member constitutes a foot rest, said seat bottom plate member is capable of extending in a forward direction further than said foot rest plate.

2. An individual chair adjustable to accommodate persons of any age and size, comprising: a pair of spaced uprights extending upwardly and rearwardly from the vertical; horizontal supporting members connected to the lower ends of said uprights and extending rearwardly of the rear surface of said uprights, said horizontal supporting members serving to support said uprights on the ground; a chair back rest interconnecting said uprights at their upper ends; a seat bottom plate member; a foot rest plate; said uprights having a plurality of horizontally extending guides provided along a portion of its length at the inner surfaces of said uprights facing each other, said seat bottom plate member and said foot rest plate each having opposite ends respectively disposed in opposite ones of said guides of said uprights at desirable locations between said ends of said uprights, said seat bottom plate and said foot rest plate extending in a forward direction from the front surfaces of said uprights, said seat bottom plate member and said foot rest plate being interchangeable so as serve as both a foot rest and a seat bottom depending on the size of the chair occupant so that when interchanged said seat bottom plate member constitutes a foot rest and said seat bottom plate member is capable of extending in a forward direction further than said foot rest plate; fastening means interconnecting said uprights together, said fastening means serving to tightly secure said foot rest plate and said seat bottom plate member in place at their desired locations along said uprights; and a strap located slightly above said seat bottom plate member and extending across said uprights thereby serving to maintain a chair occupant in place on said bottom plate, said strap being interconnected to said uprights by said fastening means.

3. An adjustable chair, comprising: a pair of upwardly extending spaced uprights having ground supporting members at their lower ends, said ground supporting members including supports extending rearwardly of the rear surfaces of said uprights; a chair back rest interconnecting said uprights at their upper ends; a seat bottom plate member; a foot rest plate; said uprights having a plurality of horizontally extending guides provided along a portion of its length at the inner surfaces of said uprights facing each other, said seat bottom plate member and said foot rest plate each having opposite ends respectively disposed in opposite ones of said guides of said uprights at desirable locations between said ends of said uprights, said seat bottom plate member and said foot rest plate being interchangeable so as to serve as both a foot rest and a seat bottom depending on the size of the chair occupant, such that when said seat bottom plate member and said foot rest plate are interchanged, said seat bottom plate member constitutes a foot rest, said seat bottom plate member is capable of extending in a forward direction further than said foot rest plate; and fastening means for tightly securing said foot rest plate and said seat bottom member in place at their desired locations along said uprights.

4. An adjustable chair, comprising: a pair of spaced uprights extending upwardly and rearwardly of the vertical; horizontal supporting members connected at the lower ends of said uprights and extending rearwardly of the rear surfaces of said uprights, said horizontal supporting members serving as ground supports for said uprights; a chair back rest interconnecting said uprights at their upper ends; a seat bottom plate member; a foot rest plate; said uprights having a plurality of horizontally extending guides provided along a portion of its length at the inner surfaces of said uprights facing each other, said seat bottom plate member and said foot rest plate each having opposite ends respectively disposed in opposite ones of said guides of said uprights at desirable locations between said ends of said uprights, said seat bottom plate member and said foot rest plate being interchangeable so as serve as both a foot rest and a seat bottom depending on the size of the chair occupant, so that when interchanged said seat bottom plate member constitutes a foot rest and said seat bottom plate member is capable of extending in a forward direction further than said foot rest plate; and fastening means for interconnecting said uprights and for tightly securing said foot rest plate and said seat bottom member in place at their desired locations along said uprights.

* * * * *